US007650703B2

(12) United States Patent
Conolly

(10) Patent No.: US 7,650,703 B2
(45) Date of Patent: Jan. 26, 2010

(54) WATERSPORT HIKING SYSTEM

(75) Inventor: Brian Conolly, New South Wales (AU)

(73) Assignee: Zhik Pty Ltd (AU)

( * ) Notice: Subject to any disclaimer, the term of this patent is extended or adjusted under 35 U.S.C. 154(b) by 163 days.

(21) Appl. No.: 11/747,661

(22) Filed: May 11, 2007

(65) Prior Publication Data

US 2007/0204481 A1 Sep. 6, 2007

Related U.S. Application Data

(63) Continuation of application No. PCT/AU2005/001718, filed on Nov. 10, 2005.

(51) Int. Cl.
*A43B 5/00* (2006.01)
*B63B 35/79* (2006.01)

(52) U.S. Cl. ..... 36/8.1; 36/4; 36/45; 114/363; 114/39.19

(58) Field of Classification Search ..... 36/8.1, 36/4, 45, 133, 113; 114/39.19, 363
See application file for complete search history.

(56) References Cited

U.S. PATENT DOCUMENTS 1,725,347 A * 8/1929 Glidden et al. ..... 36/4
3,370,363 A * 2/1968 Kaplan ..... 36/9 R
4,030,436 A * 6/1977 Stoberl ..... 114/363
4,704,810 A * 11/1987 Massengale ..... 36/130
4,910,887 A * 3/1990 Turner et al. ..... 36/114
6,467,661 B1 * 10/2002 Mistretta et al. ..... 224/264
6,523,282 B1 * 2/2003 Johnston ..... 36/133
2006/0048413 A1 * 3/2006 Sokolowski et al. ..... 36/45

FOREIGN PATENT DOCUMENTS

| | | |
|---|---|---|
| DE | 2603743 | 8/1977 |
| FR | 2475369 | 8/1981 |
| FR | 2484211 | 12/1981 |
| WO | 97/48301 | 12/1997 |
| WO | 02/00497 | 1/2002 |

OTHER PUBLICATIONS

International Search Report, Jan. 1, 2006, 3 page.

* cited by examiner

*Primary Examiner*—Ted Kavanaugh
(74) *Attorney, Agent, or Firm*—St. Onge Steward Johnston & Reens LLC

(57) ABSTRACT

A device that provides support for sailors while hiking from a sailing vessel is disclosed. The device is a hiking strap/watersport boot combination, designed to provide extra grip together. The watersport boot is ergonomically designed to support muscles in the foot that are under strain while hiking.

5 Claims, 3 Drawing Sheets

WATERSPORT HIKING SYSTEM

CROSS-REFERENCE TO RELATED APPLICATIONS

The present application is a continuation of pending International patent application PCT/AU2005/001718 filed on Nov. 10, 2005 which designates the United States and claims priority from Australian patent application 2004906449 filed on Nov. 11, 2004, the content of which is incorporated herein by reference.

FIELD OF THE INVENTION

The invention generally relates to the field of sportswear products. More specifically, the invention relates to combining a novel hiking support strap system with watersport boots, to help reduce muscle fatigue in situations such as hiking from the gunnels of a sailing vessel.

BACKGROUND OF THE INVENTION

While hiking support systems have been applied to wetsuits for dinghy sailing for some time, for hiking from a sailing dinghy 110 like that shown in FIG. 1, there have been no substantial advances in the mechanics of how the hiking strap 120 and watersport boots interact.

Currently the watersport boots are basic neoprene diving boots, adapted for sailing conditions, and with no special additions for working with the hiking strap, which is also a basic material such as a padded seat belt. Such systems provide no extra support to the hiking sailor, such as grip or boot support, that would allow the sailor to relax the foot, ease the strain of hiking, and improve the sailors competitive endurance.

SUMMARY OF THE INVENTION

It is an object of the present invention to provide an improved form of hiking system.

In accordance with a aspect of the present invention, there is provided a method of improving the hiking capabilities of a sailer, the method including the step of: providing a watersports boot including a first profiled surface for mating with a second profiled surface on a hiking strap.

The first profiled surface can comprise a grooved surface. The first profiled surface increases the coefficient of friction between the boot and strap. The watersports boot preferably can include a textured surface on top thereof and the hiking strap preferably can include a textured bottom surface. The surface can comprise a textured rubber like surface. In some embodiments the surface can comprise a flexible nitrile rubber underneath the hiking strap, and textured rubber on the top of the watersport boots. Alternatively, the surface can comprise an alternative synthetic material similar in characteristic to rubber underneath the hiking strap, and on the top of the watersport boots. The first profiled surface can be substantially a raised diamond pattern.

In accordance with a further aspect of the present invention, there is provided a watersports boot having a first profiled surface along a top surface thereof, the profiled surface designed to engage with a corresponding surface on a boat so as to provide an increased level of frictional fit there between.

In accordance with a further aspect of the present invention, there is provided a hiking system comprising: at least one watersports boot having a first profiled surface along a top surface thereof; a hiking strap having a second profiled surface designed to mate with the first profiled surface so as to provide an increased level of frictional fit there between. The surfaces are preferably formed from a rubber like material. The first profiled surface can be substantially a raised diamond pattern.

BRIEF DESCRIPTION OF THE DRAWINGS

Notwithstanding any other forms which may fall within the scope of the present invention, preferred forms of the invention will now be described, by way of example only, with reference to the accompanying drawings in which.

DETAILED DESCRIPTION OF THE INVENTION

The preferred embodiments provided a pair of watersports boots and a hiking strap designed to work together to provide extra grip. There are a number of ways in which this can be accomplished, and the challenge is to provide the extra grip while not constraining the sailor into the boat too much for safety and mobility. One particular embodiment of the invention uses a textured rubber material under the hiking strap and a similar mating material used on the top of the watersport boots. The materials provide particularly good grip, even when wet, yet do not latch the boot to the hiking strap.

The boots of the preferred embodiment are ergonomically designed to provide improved support to the muscles in the foot that are under strain while hiking. In another embodiment, the watersport boots include thick supporting material, such as rubber, to the upper parts of the boot.

Figure 1:
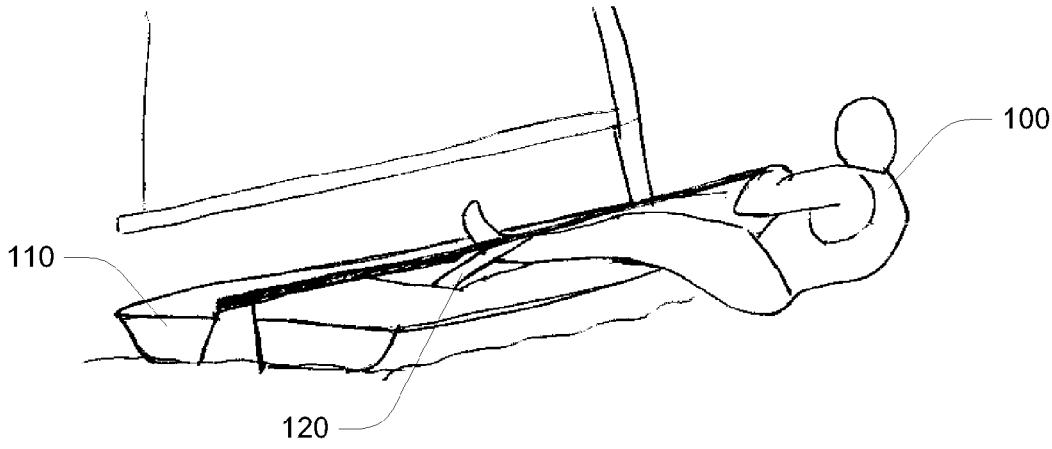
FIG. 1 illustrates a hiking sailer.
Figure 2:
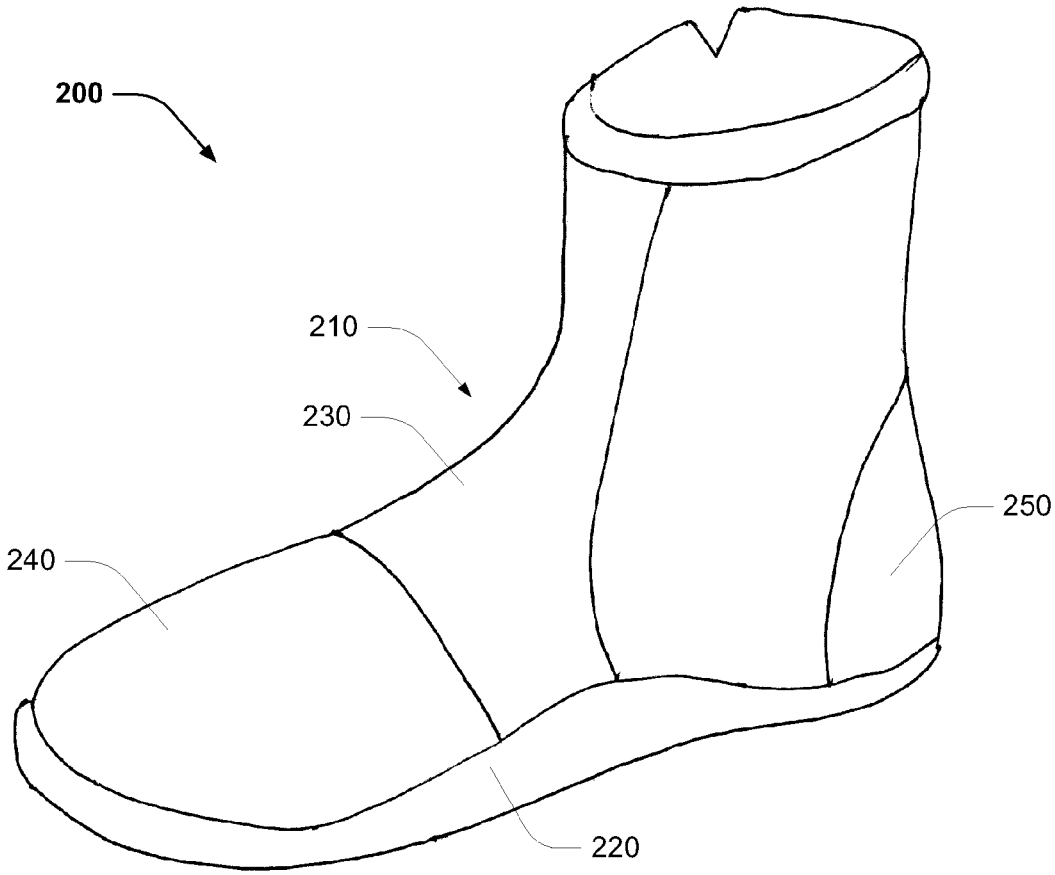
FIG. 2 illustrates the supporting areas for the watersport boots as one particular embodiment of the system.

Turning initially to FIG. 2, there is provided a watersport boot 200, constructed primarily of neoprene and rubber. In an embodiment, the whole top part of the boot 210 can be made of neoprene, typically 3 mm thick, and has a hard wearing, gripping, yet flexible sole 220. A top support panel 230, is preferably made of rubber, typically 2 mm (although optionally thicker), and is vulcanised to the neoprene. This top support panel is preferably adapted to extend from the top of the toe (under a toe support and grip panel 240) and extend toward the top of the boot, thus providing considerable support to the foot while stretched during hiking. The toe support and grip panel 240, is also preferably vulcanised to the boot, over the Top Support Panel 230, and is made of a textured rubber, typically 2 mm thick (however optionally thicker). The toe support and grip panel 240 is adapted to grip to the underside of a hiking strap. This toe support and grip panel 240, also provides extra support to this part of the foot while hiking, and extra abrasion resistance to the boot. A heel support pane 250 is also preferably formed form a rubber material vulcanised to the neoprene boot, and is also design to support the foot. In an embodiment, both the top support panel 230 and the toe support panel 240 include a profiled surface for engaging a surface of a hiking strap.

It would be appreciated that other variations of the construction and material of the boot are possible, while providing similar hiking support and grip, with similar panel areas as in this preferred embodiment.

Figure 3:
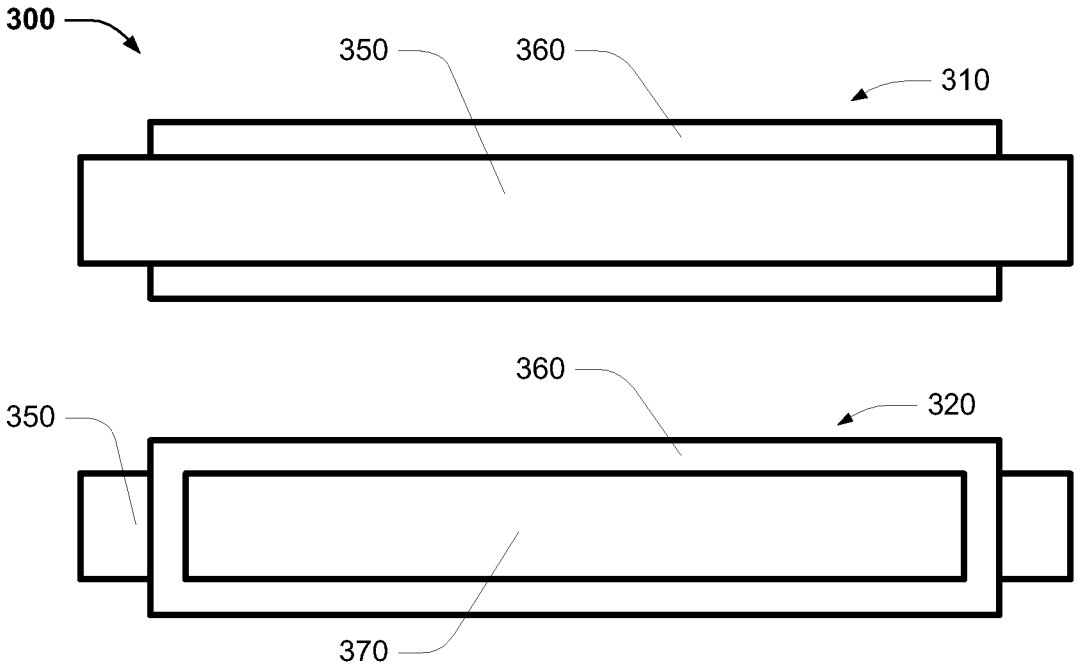
FIG. 3 illustrates the main areas for the hiking strap as one particular embodiment of the system.

Referring to FIG. 3, the main areas of an example hiking strap 300 are shown, by way of a top view 310 and an underside view 320. The main support material 350, typically in the form of a seat belt like material that is screwed or tied to the deck of a sailing vessel. A padding material 360 is typically provided for providing a sailors foot some comfort and protect it from the stiff edges of the main supporting material 350. This main supporting material 350 typically provides additional width to the strap. A further grip material 370 is also provided to improve the grip between the hiking strap 300 and a watersport boot (for example as shown in FIG. 2). In a preferred embodiment, this grip material 370 is formed of textured rubber material, vulcanised to the padding material 360.

Figure 4:
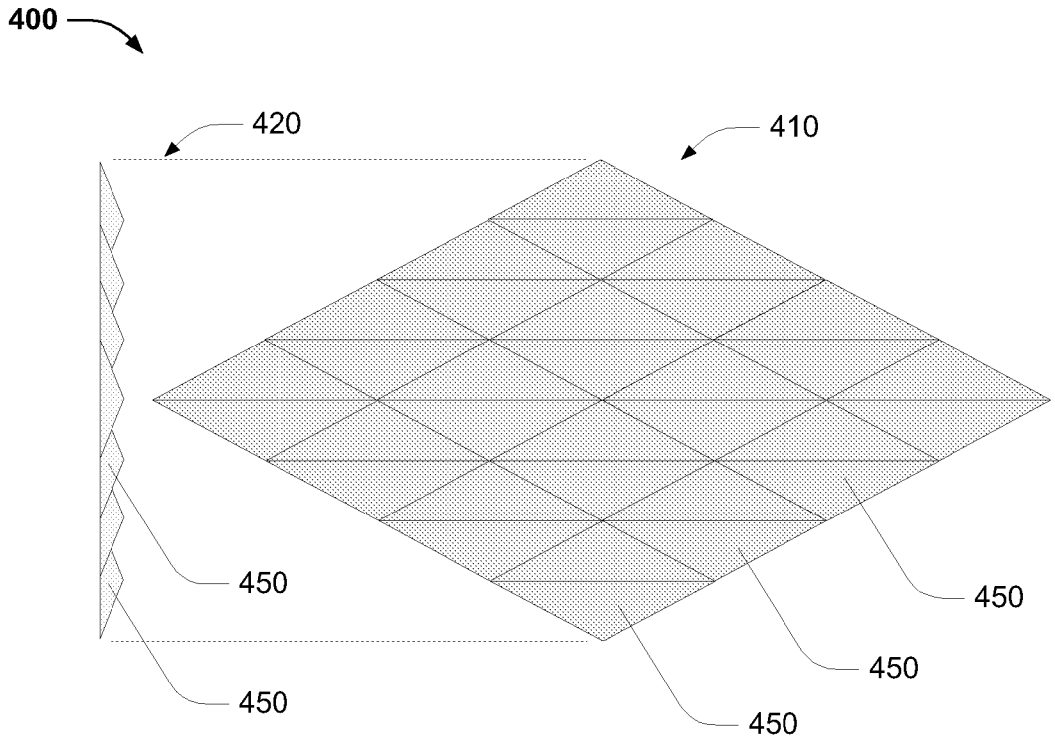
FIG. 4 illustrates an example texture grip pattern for the rubber under the strap and on top of the boot.

Referring to FIG. 4, an example texture for the rubber material 400 is shown by way of a plan view 410 and a side view 420. This particular example provides a texture in the form of a raised diamond pattern 450. For this particular raised diamond pattern, it is preferred that the ridges of the diamond peaks are orientated perpendicular to the main gripping direction when in use. In this orientation the ridges would be substantially parallel with the main length of the hiking strap when in use.

To provide substantial grip between a hiking strap and a boot, it is preferred that the pattern used for both the boot (top support panel and toe support and grip panel) and hiking strap (grip material) should be formed of the same rubber texture, with substantially the same diamond pattern dimensions. Experimenting with larger and smaller diamonds lead to variance in the gripping quality that was dependant on the depth of the raised section of the diamond. The diamonds are preferably small, approximately 2 mm in length. Other textures may also be adopted with varying degrees of grip, comfort and manufacturing cost.

Figure 5:
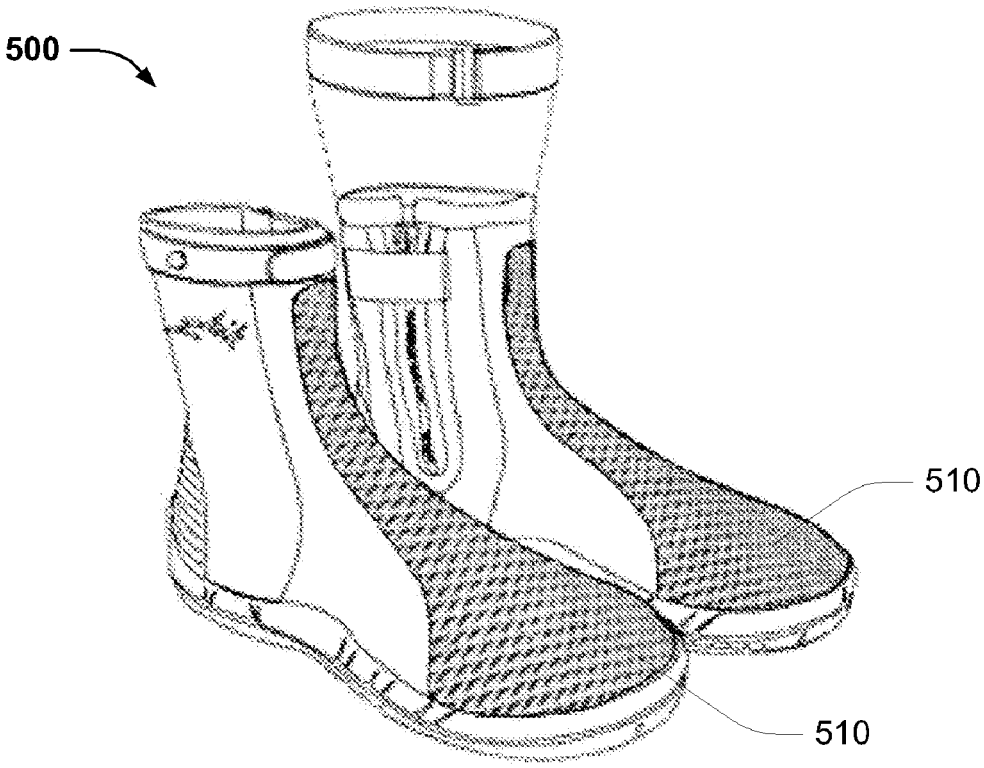
FIG. 5 illustrates a further set of hiking boots.
Figure 6:
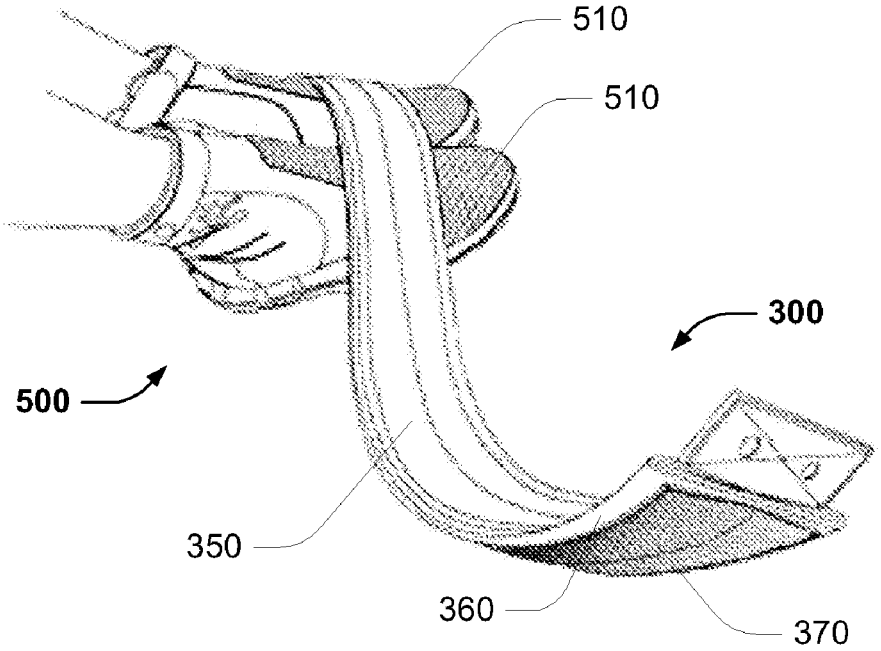
FIG. 6 illustrates the use of the hiking boots with a hiking strap.

Alternative embodiments are illustrated in FIG. 5 and FIG. 6, by way of example only.

FIG. 5 illustrates a pair of boots 500 having a grooved surface 510. In this embodiment the grooved surface 510 is preferably in the form of a raised diamond pattern 400.

FIG. 6 provides an example illustration of the boots 500 being used in association with a hiking strap 300. Preferably the grooved surface 510 and the grip material 370 are formed of the same rubber texture, with substantially the same diamond pattern dimensions, which provides a mating or frictional interconnection between the surfaces.

It will be appreciate by those skilled in the art that other mating patterns or profiled surfaces which could be utilised. By way of example, circular or oval patterns, squares, zigzags etc. may be used. It is preferred that the two surfaces (the grooved surface 510 and the grip material 370) are adapted to engage in a tight fit so as to provide for enhanced interlocking capabilities. The preferred grooved profiled surface of the boot mates with a second profiled surface on a hiking strap.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Reference throughout this specification to "one embodiment" or "an embodiment" means that a particular feature, structure or characteristic described in connection with the embodiment is included in at least one embodiment. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

The foregoing describes preferred features of the present invention. Modifications, obvious to those skilled in the art can be made thereto without departing from the scope of the invention.

What is claimed is:

1. An apparatus for improving the hiking capabilities of a sailer utilizing a hiking strap on a sailboat, the apparatus comprising:

at least one watersports boot having a first profiled surface having a series of protuberances along a top surface thereof;

a sailboat;

a hiking strap attached to said sailboat, said hiking strap having a second profiled surface having a profile which mates with said first profiled surface providing an increased level of frictional fit therebetween.

2. An apparatus as claimed in claim 1 wherein said first profiled surface is formed from a rubber like material.

3. An apparatus as claimed in claim 1 wherein said first profiled surface is substantially a raised diamond pattern.

4. An apparatus as claimed in claim 1 wherein said first profiled surface and said second profiled surface are formed from a rubber like material.

5. An apparatus as claimed in claim 1 wherein said first profiled surface and said second profiled surface are each substantially a raised diamond pattern.

* * * * *